United States Patent [19]

Bueb et al.

[11] Patent Number: 4,622,195

[45] Date of Patent: Nov. 11, 1986

[54] CONTINUOUS PROCESS FOR THE PRODUCTION OF POLYACRYLONITRILE FILAMENTS AND FIBERS

[75] Inventors: Michael Bueb; Dieter Paulini, both of Dormagen; Edgar Muschelknautz, Leverkusen; Wolfram Wagner; Herbert Gröschel, both of Dormagen, all of Fed. Rep. of Germany

[73] Assignee: Bayer Aktiengesellschaft, Leverkusen, Fed. Rep. of Germany

[21] Appl. No.: 586,578

[22] Filed: Mar. 6, 1984

[30] Foreign Application Priority Data

Mar. 11, 1983 [DE] Fed. Rep. of Germany ..... 3308657

[51] Int. Cl.[4] ..... D01S 5/22

[52] U.S. Cl. ..... 264/168; 264/206; 264/233

[58] Field of Search ..... 264/182, 168, 342 RE, 264/345, 348, 206, 233; 28/281

[56] References Cited

U.S. PATENT DOCUMENTS

| | | | |
|---|---|---|---|
| B 458,060 | 1/1976 | Reinehr et al. | 264/182 |
| 2,204,341 | 6/1940 | Cobb | 264/168 |
| 2,761,754 | 9/1956 | Jones et al. | 264/182 |
| 2,917,806 | 12/1959 | Spence et al. | 264/182 |
| 3,091,507 | 5/1963 | Mindock et al. | 264/182 |
| 3,124,631 | 3/1964 | Davis et al. | 264/206 |
| 3,663,676 | 5/1972 | Lulay | 264/182 |
| 3,671,619 | 6/1972 | Fitzgerald et al. | 264/182 |
| 3,831,233 | 8/1974 | Rendall et al. | 28/281 |

FOREIGN PATENT DOCUMENTS

| | | |
|---|---|---|
| 1760004 | 9/1971 | Fed. Rep. of Germany . |
| 2359882 | 6/1974 | Fed. Rep. of Germany . |

OTHER PUBLICATIONS

R. Wiedermann, "Acrylfaser-Spinn-und Nachbehandlungsverfahren", Chemiefasern/Textilindustrie, Jun. 1981, pp. 481–484.

Synthesefasern, Verlag Chemie, 1981, pp. 96–104, 205–206.

*Primary Examiner*—Donald Czaja
*Assistant Examiner*—Hubert C. Lorin
*Attorney, Agent, or Firm*—Sprung Horn Kramer & Woods

[57] ABSTRACT

Polyacrylonitrile filaments and fibers may be obtained without interruption by spinning the spinning solution into a hot-air spinning duct, washing, drawing, crimping, preparing, steaming, drying cooling and, optionally, cutting at a take-off rate kept at 150 to 400 m/minute and for a tow weight of from 10 to 100 g/m when (a) the washing process is carried out in several stages on the countercurrent principle and a vibrating duct is used for transporting the spun tow through the washing process, (b) drawing is carried out before and/or after washing in a steam atmosphere at 100° to 120° C., (c) crimping is carried out in an aerodynamic crimping unit using a hot, gaseous medium under a pressure of from 5 to 16 bars and at a temperature in the range from 50° to 210° C., (d) the preparation is continuously applied to the tow before, during or after crimping, (e) for steaming, the tow is transported through a steaming apparatus in folded form and in the absence of tension on a vibrating duct and, at the same time, treated with steam at 100° to 120° C., (f) finally, the tow is dried in folded form on a belt dryer using hot air at 60° to 180° C., subsequently cooled with cold air to temperatures below 50° C. and, optionally, delivered to a cutting machine.

13 Claims, 2 Drawing Figures

CONTINUOUS PROCESS FOR THE PRODUCTION OF POLYACRYLONITRILE FILAMENTS AND FIBERS

Figure 1:
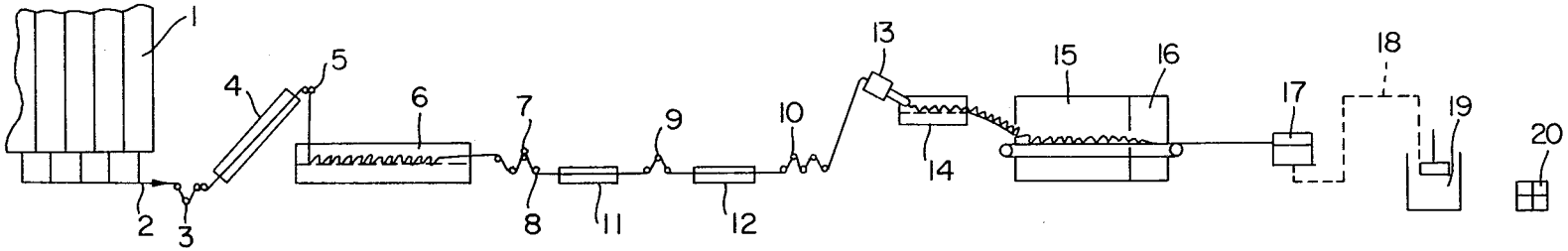

This invention relates to a continuous process for the production of polyacrylonitrile filaments and fibers in which the spun material is produced by dry spinning.

Polyacrylonitrile filaments are produced by dissolving the polymer in a suitable solvent, for example dimethyl formamide, and extruding the spinnable solution through a spinneret. If the filaments are hardened by coagulation in a generally aqueous liquid ("precipitant"), they are said to be wet spun; if they are hardened by evaporation of the solvent in a hot-air spinning duct, the filaments are said to be dry spun.

After spinning, the filaments have to be subjected to an aftertreatment to acquire the desired physical and processing properties. This aftertreatment is understood to include such typical process steps as washing (solvent extraction), drawing, crimping, preparation, drying, steaming and cutting.

In the case of wet spinning, the continuous procedure, in which spinning and aftertreatment are carried out without interruption, was adopted at an early stage in order to improve economy. This is readily possible at the relatively low spinning speeds of 5 to 20 m/minute typical of wet spinning because the residence times required for the aftertreatment processes may be obtained without difficulty through corresponding tow lengths in the apparatus. The situation is completely different with dry spinning. On account of the relatively high spinning speeds of 150 to 400 meters per minute which are necessary in order to be able to compete with wet spinning in view of the far smaller numbers of spinning bores than in the wet spinning process and also on account of the 10 times slower speed of entry into the aftertreatment process (15 to 40 meters per minute), the aftertreatment process is separated from the spinning process. To that end, the tow is deposited into a can after leaving the spinning machine and delivered from several such cans to an aftertreatment line. An interruption such as this between the spinning and aftertreatment processes involves major disadvantages, for example high production costs, more waste, solvent emission from the spinning cans, variations in product quality.

Nevertheless, it has not been possible to avoid this interruption. Thus, for example R. Wiedermann writing in Chemiefasern/Textilindustrie, June 1981, pages 481 to 484, states that, in dry spinning, the tows "are delivered to a can filling unit at speeds of from 300 to 600 meters per minute. The tow cannot be drawn and aftertreated at speeds in that range because residence time is a crucial factor in the removal of residual solvent by washing. For this reason, dry spinning processes for acrylic fibers are non-continuous." In addition, in the book by B. von Falkai entitled "Synthesefasern (Manmade Fibers)", Verlag Chemie, Weinheim, Deerfield Beach/Florida, Basel, 1981, the following passage appears on page 205: "In wet spinning, the spun filaments immediately enter the aftertreatment process. In dry spinning, the spun filaments deposited in cans are doubled to form tows weighing from 40 to 100 g/m, several such tows being aftertreated on a single aftertreatment line".

Although continuous processes in which dry spinning and aftertreatment are carried out without any interruption have already been proposed, cf. U.S. Pat. No. 2,811,409, these processes are confined to the production of so-called "acrylic silks", i.e. polyacrylonitrile filament yarns characterized by very low tow weights. The technical teachings put forward in the above-mentioned U.S. Patent differ from and are also not applicable to the process according to the invention.

A process for the continuous wet treatment, particularly washing, of groups of filaments at speeds of up to 150 meters per minute is described in DE-A-1 760 004. In this known process, washing solution is briefly passed through tne groups of filaments transversely of their direction of travel at the beginning of the aftertreatment, after which the fibers are left in a treatment liquid for a prolonged period to remove the extractable substances present therein. Between the individual treatments, water is removed by squeezing out. The groups of filaments are transported by rollers. The machinery required for this process is elaborate and is not designed for speeds of more than 150 meters per minute.

DE-A-2 359 882 describes a process for dyeing dry-spun polyacrylonitriie filaments still containing spinning solvent. In this process, the filaments are washed, squeezed out, dyed without drawing in a dye bath and then drawn while still in contact with the liquid dye mixture, followed by drying in the usual way. The process which may be carried out continuously after spinning is only designed for maximum speeds of less than 100 meters per minute.

Accordingly, the object of the present invention is to provide a continuous process for the production of polyacrylonitrile filaments and fibers, in which the spun material is produced by dry spinning and delivered without interruption to the aftertreatment line. A precondition in this respect was that the spinning take-off rate from the spinning duct should not fall below about 150 m/minute, nor should the weight of the sliver in the aftertreatment stage be any less than about 10 g/m in order not to jeopadize the economy of the process. It has now been found that the disadvantages of previous processes can be overcome by means of a process which, compared with hitherto known dry spinning processes, involves lower production costs, less waste and considerably less solvent emission and which gives products of more uniform quality which process involves carrying out the individual aftertreatment steps in a certain sequence and using certain apparatus for carrying them out. Although substantially the same aftertreatment steps are known from existing, noncontinuous processes and although machinery similar to the machinery used in the process according to the invention has been used in a different connection, for example for lower speeds or lower tow weights, it must nevertheless be regarded as surprising that the process according to the invention as described hereinafter is able to solve the problem outlined in the foregoing because experts were of the opinion (cf. the literature references cited on page 3)—precisely in view of their knowledge of the individual process steps, the sequence in which they are carried out and the machinery used—that a process for the production of polyacrylonitrile fibers consisting of dry spinning and aftertreatment without any separation between these two stages would not be economically viable.

Accordingly, the present invention provides a process for the production of polyacrylonitrile filaments and fibers by spinning the spinning solution into a hot-air spinning duct, washing, drawing, crimping, preparating, steaming, drying, cooling and, optionally, cutting, characterized in that the dry-spun tow is taken off at a speed of 150 to 400 meters per minute and, without any interruption, is introduced into the aftertreatment stages with a tow weight of from 10 to 100 g/m, (a) the washing process being carried out in several stages on the countercurrent principle and a vibrating duct being used to transport the tow through the washing process, (b) drawing being carried out in a steam atmosphere at 100° to 120° C. before and/or after the washing process, (c) crimping being carried out in an aerodynamic crimping unit using a hot, gaseous medium under a pressure of from 5 to 16 bars and at a temperature of from 50° to 210° C., (d) the preparation being continuously applied to the tow before, during or after crimping, (e) steaming being carried out by transporting the tow in folded, tension-free form on a vibrating duct through a steaming apparatus and, at the same time, treating it with steam at 100° to 120° C., and (f) the tow finally being dried in folded form on a belt dryer using air heated to 60°–180° C., subsequently cooled with cold air to temperatures below 50° C.

The cut fibers may be continuously conveyed by a pneumatic conveyor from the cutting machine to the bale press where they are made up into finished bales.

The washing process is preferably carried out by sprinkling washing liquid onto the folded tow in each stage, most of the washing liquid trickling through the tow and its transporting duct within the stage and subsequently being collected in a receiver below the tow transporting duct and repeatedly returned to the same stage for sprinkling onto the tow. A suitable washing apparatus is described in DE-A-2 950 014.

The drawing process may be carried out in one or more stages with overall drawing ratios of from 1:2 to 1:5. Drawing is preferably carried out in steam-filled tubes. The preparation is preferably applied in the crimping nozzle, the aerodynamic crimping unit preferably being in the form of an injector using superheated steam or hot air. The crimping nozzle is preferably in the form of an annular-gap injector nozzle consisting of an entrance, a mixing chamber, a diffusor and a wire cage.

The vibrating duct, on which the crimp applied to the tow is fixed and the shrinkage removed, is preferably combined with the crimping nozzle to form a single unit in such a way that the crimping steam escaping from the wire cage of the crimping nozzle may be used for steaming in the steaming process.

The dryer is preferably divided up into several compartments which may be heated to different temperatures, generally descending in the direction of travel of the tow. The last compartment, which acts as a cooling zone, is filled with air at room temperature.

The vibrating ducts are preferably vibrated by eccentric drives or by electromagnets. The vibrating duct of the washing stage preferably comprises bases of perforated plates, sieve cloths or slotted plates having a free cross-sectional area of 10 to 50%.

The process according to the invention and the preferred crimping nozzle are described in more detail in the following with reference to the accompanying drawings, wherein:

FIG. 1 diagrammatically illustrates the process as a whole and one possible embodiment of an apparatus in which it may be carried out.

Figure 2:
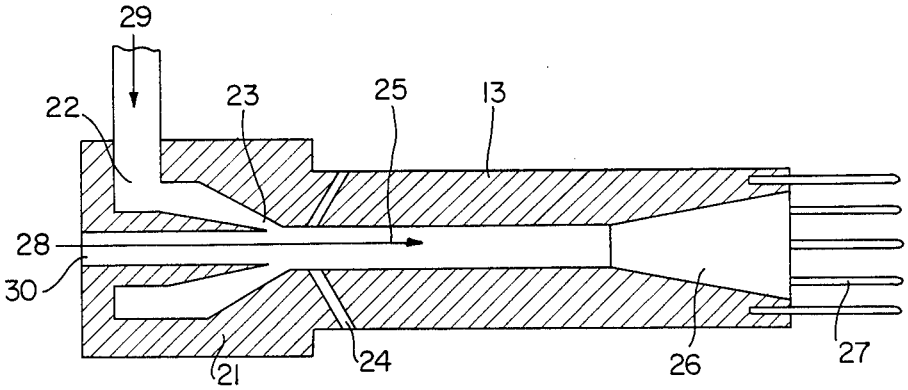

FIG. 2 diagrammatically illustrates the preferred crimping nozzle.

Fibers are dry-spun in the spinning ducts of a dry spinning machine (1) from a spinning solution of polyacrylonitrile and solvent (for example dimethyl formamide) having a solids content of from 20 to 40%.

The fibers are doubled to form a tow (2) weighing from 10 to 100 g/m and are taken off at a spinning speed of 150–400 m/minute by take-off rolls (3). After dry spinning, the fibers still contain approximately 5 to 20% of solvent (for example dimethyl formamide). Solvent extraction is carried out in a washing apparatus (6) in which the folded tow is subjected to countercurrent washing with hot water (60°–95° C.) in 10 to 30 stages.

Difficulties may be involved in coupling the continuous aftertreatment apparatus onto a spinning machine while it is running because this operation has to be carried out very quickly and requires special technology. The tow is first taken off by the take-off rolls (3) and deposited in a disposable can. At the moment the continuous aftertreatment is coupled on, the tow is suddenly delivered by means of a compressed-air injector through a spreading tube (4) to the delivery rolls (5) of the washing apparatus (6) and introduced into the delivery rolls. The tow is then deposited in coils onto the transporting surface of the washing apparatus by a traversing depositing unit in the form of a tube. In the depositing unit, there is an annular jet which is supplied with washing water and which sprays the tow with water to make it easier to remove from the delivery rolls (5) and to obtain a compact, compressed tow on the transporting surface of the washing apparatus. The folded tow is transported at 1 to 4 meters per minute on a perforated plate with lateral boundary walls which is part of a vibrating duct. A folding factor of approximately 50–150 is dictated by the ratio of the speed at which the tow is delivered to the washing apparatus to the speed at which the tow cake is conveyed in the washing apparatus. The sprinkling of the tow cake with water in each stage has to be carried out so carefully that none of the fibers floats and no tangling or matting occurs. This is made possible by sprinkler boxes which are arranged as closely as possible over the tow cake and from the bores of which the water only flows under the effect of gravity, impinging on the tow cake at a rate of flow of less than 1 m/s. The required input of fresh water amounts to 0.7–2 kg of water per kg of fibers. The residence time of the tow in the washing apparatus amounts to between 2 and 6 minutes. Before leaving the washing apparatus, the tow is pulled flat again and then mechanically freed from water to a water content of 30–50% by passage through squeezing rollers (7). The solvent content of the tow after leaving the washing apparatus amounts to approximately 1–2%.

The rate at which the tow enters the drawing stage has to be regulated in such a way that the point of separation of the tow cake in the washing apparatus is always situated at the same place. The point of separation may be detected by means of photocells or by an inductive detection probe.

One particular difficulty arises when so-called runners accur between the drawing rolls and drawing has to be briefly interrupted. Since the spinning machine and the washing apparatus continue to run, the tow cake continues to travel through the washing apparatus up to the end thereof. To ensure this is possible without interference for a short interruption time of around 1 minute, it is best to provide a buffer zone between 1 and 4 meters long at the end of the washing apparatus.

Drawing of the tow takes place in hot steam in two stages or drawing zones. Between the drive rollers (8) and (9), around which the tow passes, the tow is drawn in a ratio of from 1:1.1 to 1:2 in the first stage and, at the same time, heated by passage through a 1–3 m long steam pipe or steam duct (11) into which steam at 100° to 130° C. is injected. Between the drive rollers (9) and (10), the main drawing process takes place in a ratio of 1:2 to 1:6 in a 3 to 7 m long steam tube or steam duct (12) into which steam at 100° to 130° C. is injected. The speed of travel of the tow at the drive rollers (10) amounts to between 500 and 2000 meters per minute, depending upon the spinning speed and the drawing ratio adjusted.

It has surprisingly been found that low-solvent polyacrylic tow can be drawn at high speeds providing drawing is carried out in accordance with the invention, i.e. in two stages in steam having a temperature of at least 100° C. In another embodiment of the invention, drawing is carried out in a steam tube in which an excess pressure of from 0.1 to 2 bars is adjusted by means of pressure barriers at the entrance and exit, so that drawing can be carried out at saturated steam temperatures of up to 130° C. In one preferred embodiment of the drawing process, the tow is pneumatically introduced into the steam pipe by means of integrated injectors. The drawn tow is then crimped at the same speed in a steam crimping nozzle (13). An aerodynamic crimping unit such as this consists in principle of an injector which is operated with superheated steam or hot air (5–16 bars and 50°–210° C.) and under the effect of which the tow is, on the one hand, continuously drawn under suction into the nozzle and, on the other hand, compressed or crimped in the nozzle. As a result of compression and crimping, the rate of travel of the tow is reduced by a factor of from 10 to 20, so that the compressed and crimped tow leaves the crimping unit at a speed of from 50 to 200 meters per minute.

Compared with a mechanical stuffer-type crimping machine, an aerodynamic crimping nozzle generates a compressive force lower by a factor of 3 to 9. However, it has surprisingly been found that even a weak compressive force is entirely adequate for producing sufficiently intensive crimping providing the tow is crimped in the presence of steam at 150° to 200° C.

When the dimensions of the crimping nozzle are being established, it is important to bear in mind that the ratio $$\frac{\text{cross-sectional area of nozzle}}{\text{cross-sectional area of tow}} = \frac{A_D}{A_B}$$

should be between 5 and 50 to obtain adequate intensity of crimping. The cross-sectional area of the tow may be determined in accordance with the following relation:

$$A_B = \frac{M}{L \cdot p}$$

where M is the weight of the tow in [kg], L is the length of the tow in [m] and p is the density of the fibers in [kg/m$^3$]. Substantially three-dimensional crimping is obtained.

Tows normally have to be wetted with a preparation to obtain desired adhesion and sliding properties of the fibers and to avoid electrostatic charging. In the process according to the invention, a preparation such as this may be continuously applied to the tow. It has surprisingly been found that the continuous application of an aqueous preparation can take place directly in the crimping nozzle (13) because, under the effect of the flow of steam, the preparation is uniformly distributed over all the fibers.

The preparation is an approximately 5 to 20% by weight oil-in-water emulsion which is applied in a quantity of from 0.2 to 0.6% by weight of oil, based on fiber solids. Suitable oils are known to the expert.

The crimped and folded tow cake is then transported in the absence of tension on a vibrating duct through a steaming apparatus (14) in which it is exposed to steam at 100° to 120° C. for between 0.1 and 2 minutes.

After the individual stages of washing, drawing, crimping, preparating and steaming, the tow still has a water content of from 30 to 60%. This water has to be removed by a thermal drying process. To this end, the crimped tow is uniformly deposited in folded form onto a belt dryer (15) by means of a traversing mechanism and, on its transporting support, passes through the dryer in 2 to 10 minutes at speeds of 0.1 to 3 m/minute. Drying is carried out with air heated to between 60° and 180° C., depending on the required drying conditions. Before cutting, the tow has to be cooled to temperatures below 50° C. so that the crimp is not eliminated by the strain of cutting. Accordingly, part of the dryer is constructed as a cooling zone (16), in which cold air is blown onto the tow. Before leaving the dryer, the tow cake is broken up again by rapidly removing the tow at speeds of from 500 to 1500 meters per minute. Still traveling at that speed, the tow is then optionally cut into 30–150 mm long staple fibers in a cutting unit (17). The fiber flocs are pneumatically conveyed through a pipe (18) to the bale press (19) where they are compressed into packaged fiber bales (20).

The speed of operation of the cutting machine (17) has to be regulated in such a way that the tow cake always separates at the same place at the end of the dryer. Otherwise, the dryer would empty due to an excessive cutting speed or would be overfilled due to an inadequate cutting speed. An adjustment such as this may be made by means of photocells.

The crimping nozzle (13) shown in FIG. 2 consists of an entrance (21), a mixing chamber (25), a diffusor (26) and a wire cage (27). The tow (28) is taken in under suction through the orifice (30). A hot gas (29) is delivered through the feed pipe (22) and the annular gap (23), heating and conveying the tow. The two bores (24) are used for introducing the preparation.

The entrance zone of the nozzle is preferably 50 to 100 mm long and from 8 to 15 mm in diameter. The width of the annular gap is preferably between 0.2 and 0.6 mm. At the narrowest point, the inflowing hot gas reaches speeds of 450 to 500 m/second for a temperature of 100° to 150° C. The angle between the inflowing hot gas and the tow is less than 20° .

The following mixing chamber is between 100 and 200 mm long and 9 to 16 mm in diameter. The tow is transported through the nozzle by the gas velocity of 150 to 200 m/second.

In the diffusor, the tow opens out and is then decelerated and crimped in the wire cage. The wire cage is between 20 and 30 mm in diameter and between 100 and 200 mm long and consists of approximately 20 to 50 concentrically arranged steel wires 0.5 to 2 mm thick which may be equal or different in length. The hot gas escapes laterally through the wires.

It has been found that the continuous aftertreatment of dry-spun acrylic fibers coupled without interruption onto the spinning process is made possible solely by the order in which the individual process stages are carried out in accordance with the invention and by the machinery used in accordance with the invention for carrying out the individual process stages.

EXAMPLE

Polyacrylonitrile consisting of 93.6% by weight of acrylonitrile, 5.7% by weight of methyl acrylate and 0.7% by weight of methallyl sulfonate and having a K-value of 81 was dry spun in the form of a 30% by weight solution in dimethyl formamide (DMF). The take-off rate of the fibers from the spinning duct was 240 m/minute. The individual fiber denier amounted to 10 dtex and the total weight of the undrawn tow 20 g/m. After leaving the spinning machine, the filaments still had a DMF content of 17% by weight. After folding, the tow was washed in a 20-stage washing apparatus through which it was transported in a vibrating duct. The residence time of the tow in the washing apparatus was approximately 3 minutes, the temperature of the washing water approximately 90° C. and the quantity of fresh water used 1kg per kg of filaments. The tow left the washing apparatus with a DMF content of 1% and at a speed of 200 meters per minute. After washing, the tow was drawn in two stages in steam pipes filled with saturated steam heated to 100° C. In the first stage, the drawing ratio was 1:1.3 and, in the second stage, 1:2.85, the tow leaving the second drawing stage at a speed of approximately 1000 m/minute. After drawing, the tow was crimped in a steam nozzle fed with saturated steam under a pressure of 9 bars. The crimping nozzle used corresponded to that shown in FIG. 2, the entry orifice having a diameter of 9 mm, the mixing chamber a diameter of 12.5 mm and the annular gap a width of 0.39 mm for a total area of the annular gap of 15.2 $mm^2$. A 10% by weight oil-in-water emulsion serving as preparation is pumped by two gear pumps through the two bores (24) in such a quantity that 0.45% by weight of oil, based on fiber solids, is applied.

The total length of the crimping nozzle was 500 mm. The wire cage consisted of 30 wires 1 mm in diameter. The temperature of the steam in the annular gap was 121° C. and its flow velocity 480 m/second.

After crimping, the crimping cake was steamed in a steaming apparatus using the steam issuing from the wire cage of the crimping nozzle. The residence time was 15 seconds in a steam atmosphere at approximately 100° C. After leaving the steaming apparatus, the tow still contained approximately 40% of water and had a boiling-induced shrinkage of 2%. For drying, the crimped and folded tow was deposited on a belt dryer with 4 drying compartments circulating at a speed of 0.8 m/minute. The air temperature in the first three drying compartments was 150° C. and, in the fourth compartment, 20° C. The residence time in the dryer was 3 minutes. After leaving the dryer, the tow had a water content of only 1% and a temperature of 30° C. The tow was run off at a speed of 620 m/minute, cut into 60 mm long staple fibers in a rotor cutting machine and subsequently packaged into bales in the bale press. The staple polyacrylonitrile fibers thus produced could be processed on a card at a card speed of 120 m/minute. The individual fibers had a denier of 3.3 dtex, a tensile strength of 24 cN/tex, a breaking elongation of 30%, a residual solvent content of 0.1% and did not contain any vacuoles. The crimp contraction amounted to 11.2% and crimp stability to 74.6%.

These values are determined as follows:

The crimped filament is suspended at one end and loaded with a weight of 0.001 cN/dtex. Its length is $l_0$. The load is increased to 0.1 cN/dtex. Its length is now $l_1$. The load is then decreased back to 0.001 cN/dtex. Its length is now $l_2$.

$$\text{The crimp contraction } (CC) \text{ works out at } \frac{l_1 - l_0}{l_1}$$

$$\text{The residual crimp } (RC) \text{ works out at } \frac{l_1 - l_2}{l_1}$$

$$\text{The crimp stability follows from } \frac{RC}{CC} \cdot 100$$

We claim:

1. A process for the production of polyacrylonitrile filaments and fibers comprising spinning a spinning solution in a hot-air spinning duct, taking off a dry spun tow at a speed of 150 to 400 m/minute and, without interruption, introducing the dry-spin tow having a tow weight of 10 to 100 g/m, to an after-treatment comprising:
   (a) washing,
   (b) drawing,
   (c) crimping,
   (d) preparating,
   (e) steaming,
   (f) drying and cooling,
   said washing being carried out in several stages on the countercurrent principle and a vibrating duct being used to transport the tow through the washing process,
   said drawing being carried out in a steam atmosphere at 100° to 130° C. before and/or after the washing process,
   said crimping then being carried out in an aerodynamic crimping unit using a hot, gaseous medium under a pressure of from 5 to 16 bars and at a temperature of from 50° to 210° C.,
   said preparating being continuously applied to the tow before, during or after crimping,
   said steaming being carried out by transporting the tow in folded, tension-free form on a vibrating duct through a steaming apparatus and, at the same time, treating it with steam at 100° to 120° C., and
   said drying conducted in folded form on a belt dryer using air heated to 60°–180° C., and said cooling conducted with cold air to temperatures below 50° C.

2. A process as claimed in claim 1, characterized in that the washing process is carried out in 10 to stages using 0.7 to 2 kg of water heated to 60°–95° C. per kg of fibers by spraying washing liquid onto the folded tow in each stage, most of the washing liquid trickling through the tow and through the tow transporting duct within the stage, subsequently being collected in a receiver below the tow transporting duct and being repeatedly returned for sprinkling onto the tow in the same stage, the residence time of the tow in the washing apparatus amounting to between 2 and 6 minutes.

3. A process as claimed in claim 1, characterized in that drawing is carried out in one or more stages with overall drawing ratios of from 1:2 to 1:5.

4. A process as claimed in claim 1, characterized in that the preparation is applied to the tow in the crimping nozzle.

5. A process as claimed in claim 1, characterized in that crimping is carried out with steam and the steam issuing from the crimping unit is used for the steaming operation(e).

6. A process as claimed in claim 1, characterized in that the crimping step is carried out in the crimping unit having a crimping nozzle in which the quotient of the cross-sectional area of the nozzle to the cross-sectional area of the two is between 5 and 50.

7. A process according to claim 1 wherein steaming takes place after drawing.

8. A process according to claim 1 wherein drawing takes place in two stages, a first stage in which the tow is drawn in a ratio of from 1:1 to 1:2 and a second stage in which the tow is drawn in a ratio of 1:2 to 1:6.

9. A process according to claim 1, wherein drawing is carried out in a steam tube, having an entrance and exit, in which an excess pressure of from 0.1 to 2 bars is adjusted by a pressure barrier at said entrance and exit.

10. A process in accordance with claim 1, wherein the crimping is carried out in an aerodynamic crimping unit comprising an annular-gap injector nozzle having an entrance, a mixing chamber, a diffusor and a wire cage.

11. A process in accordance with claim 1, wherein the vibrating duct of the washing process comprises bases of perforated plates, sieve cloths or slotted plates having a free cross-sectional area of 10 to 50%.

12. A process in accordance with claim 1, wherein the tow is delivered to a cutting machine after drying and cooling.

13. A process in accordance with claim 1, wherein said drawing is carried out in a steam atmosphere at 100° to 120° C.

* * * * *

UNITED STATES PATENT AND TRADEMARK OFFICE

CERTIFICATE OF CORRECTION

PATENT NO. : 4,622,195

DATED : November 11, 1986

INVENTOR(S) : Michael Bueb, et al.

It is certified that error appears in the above-identified patent and that said Letters Patent are hereby corrected as shown below:

| | |
|---|---|
| Title Page, under "U.S. Patent Documents", line 5 | Delete "Mindock" and substitute --Murdock-- |
| Col. 2, line 11 | Delete "tne" and substitute --the-- |
| Col. 2, line 21 | Correct spelling of --polyacrylonitrile-- |
| Col. 8, line 59 | After "10 to" insert --30-- |
| Col. 10, line 1 | After "from" delete "1:1" and substitute --1:1.1-- |

Signed and Sealed this

Twenty-fourth Day of February, 1987

*Attest:*

DONALD J. QUIGG

*Attesting Officer*

*Commissioner of Patents and Trademarks*